US006490816B2

(12) United States Patent
Ketting

(10) Patent No.: US 6,490,816 B2
(45) Date of Patent: Dec. 10, 2002

(54) TOOTH CAP FOR CONSTRUCTION MACHINERY

(75) Inventor: Michael Ketting, Ennepetal (DE)

(73) Assignee: Intertractor GmbH, Gevelsberg (DE)

( * ) Notice: Subject to any disclaimer, the term of this patent is extended or adjusted under 35 U.S.C. 154(b) by 0 days.

(21) Appl. No.: 09/853,091

(22) Filed: May 10, 2001

(65) Prior Publication Data

US 2002/0043010 A1 Apr. 18, 2002

(30) Foreign Application Priority Data

May 11, 2000 (DE) ..... 100 22 629

(51) Int. Cl.[7] ..... E02F 9/28
(52) U.S. Cl. ..... 37/454; 172/753
(58) Field of Search ..... 37/452, 453, 454, 37/460, 450, 449, 446; 172/772, 772.5, 761, 753; D15/29

(56) References Cited

U.S. PATENT DOCUMENTS 2,247,202 A * 6/1941 Ratkowski
2,360,315 A * 10/1944 Campbell et al.
3,286,379 A * 11/1966 Benetti
3,309,801 A * 3/1967 Ratkowski
3,312,002 A * 4/1967 Benetti
3,736,676 A * 6/1973 Sturgeon
3,959,901 A * 6/1976 Klett
5,081,774 A * 1/1992 Kuwano
5,111,600 A * 5/1992 Lukavich et al.
5,375,350 A * 12/1994 Maybon
5,502,905 A * 4/1996 Cornelius et al.
5,966,848 A * 10/1999 Monteiro, Jr. et al.

FOREIGN PATENT DOCUMENTS

| | | | | |
|---|---|---|---|---|
| DE | 2744497 A | * | 4/1979 | ..... 37/454 |
| GB | 2176520 A | * | 12/1986 | ..... 37/454 |
| SU | 883286 | * | 11/1981 | ..... 37/454 |

* cited by examiner

*Primary Examiner*—Victor Batson
(74) *Attorney, Agent, or Firm*—Herbert Dubno

(57) ABSTRACT

A tooth cap for construction machinery having a chisel-shaped body formed with a socket and a wedge-shaped portion extending from the socket and having a pair of mutually converging working flanks, at least one of the working flanks being formed with a plurality of ribs.

15 Claims, 20 Drawing Sheets

TOOTH CAP FOR CONSTRUCTION MACHINERY

FIELD OF THE INVENTION

My present invention relates to a tooth cap for construction machinery and, more particularly, to a tooth cap having a socket portion which fits onto a stub of a bucket, shovel, scoop or other excavating unit of a construction machine, a wedge-shaped portion for biting into the ground and having two surfaces or flanks which converge toward one another and adjoin in a tip forming a cutting edge.

BACKGROUND OF THE INVENTION

Tooth caps for construction machinery are wear parts of buckets, scoops, shovels, scoopers and like earth-engaging units of such machinery and are known in a variety of configurations. In general, the apparatus has a frustopyrimidal holder on the bucket, scoop or shovel which receives a tooth cap which is a chisel-like member replaceable on the holder in the case of breakage or wear.

The tooth cap can have an opening or socket which form-fittingly receives the holder and can be held thereon by an appropriate fastening element such as a pin which, for replacement of the tooth cap, can be knocked out to release the tooth cap from the holder. The socket forms a one-piece body with a wedge-shaped portion which constitutes the chisel part of the cap. The chisel part can be formed by a pair of broad surfaces or flanks which converge toward the tip of the tooth cap and may form a cutting edge at that tip. The result is a wedge-shaped body in which the convergent flanks form working surfaces.

It has been found that when such a tooth cap is driven into the ground, there is a tendency for the resistance of the ground to penetration to continuously increase with such penetration so that there is significant compaction of the ground and resistance to penetration ahead of the tip or edge of the tooth cap. Not only does this increase the force necessary to operate the machine, but it also increases the wear on the tooth cap.

OBJECTS OF THE INVENTION

It is, therefore, the principal object of the present invention to provide a tooth cap which is capable of penetration into the ground with a minimum of force and which results in only limited compaction of the earth in the course of such penetration and thus has reduced wear.

Another object of this invention is to provide a tooth cap for construction equipment which has improved ground penetration and can be utilized with greater efficiency than earlier systems.

Another object of the invention is to provide a tooth cap for the purposes described which avoids drawbacks of prior art tooth cap arrangements.

SUMMARY OF THE INVENTION

These objects and others which will become apparent hereinafter are attained, in accordance with the invention by providing a tooth cap of the type described in which at least one of the working surfaces or flanks is provided with a plurality of longitudinal ribs and/or transverse ribs.

It has now been found that, when the wedge-shaped portion which extends from the socket to the tip or cutting edge has a plurality of longitudinal ribs on at least one of the flanks of the pair of mutually-converging flanks defining the wedge-shaped portion and the ribs are relatively close together, the penetration of the tooth cap into the ground or the like is greatly facilitated because the ribs induce a displacement of the earth or rock without significant compaction of the ground while the spaces between the ribs appear to remain generally free from the earth and thus provide quasi-free spaces which remain as the tooth drives into the ground. As a consequence the friction against the tooth cap is reduced, the penetration with a certain driving force is increased and the wear on the tooth is reduced.

The spaces between the ribs serve to loosen the soil or the ground and thereby contribute to a reduced compaction because the amount of force required to drive the teeth of the tool into ground is reduced and the wear on the tooth cap is likewise reduced, lighter capacity machinery may be utilized for a given job.

Transverse ribs can be used in addition or alternatively and the transverse ribs appear to operate by presenting to the ground into which the tooth is driven, a wave-like pattern which likewise serves to displace the material and leave free space, generally behind the crests of the ribs so that again compaction is reduced along with friction against the tooth cap and the force with which the latter must be driven into ground can be reduced as well. Here again the ribs contribute to a loosening of the ground.

It has been found to be advantageous to recess at least one of the working flanks of the tooth cap and preferably the working flank provided with the ribs in a direction transverse to the longitudinal dimension or extent of the wedge-shaped pattern in a domed or curved pattern. The recess or indentation can extend between the edges of the wedge-shaped portion and the longitudinal ribs can be generally parallel to these edges.

The tooth cap as a whole can be relatively flat, i.e. the wedge angle may be small and the tooth cap can progressively be thicker toward the socket end of the tooth cap in a progressive manner. This configuration has been found to be optimum in reducing the force with which the tooth cap must be driven into the ground.

It has been found, in conjunction with such a configuration, to be advantageous to set back the height of the ribs below the edges of the wedge-shaped portion. The slightly higher edges tend to provide guides for the tooth cap which function similarly to the longitudinal ribs and facilitate penetration of the tooth cap into the ground.

Advantageously, the longitudinal ribs have a mutual spacing which is greater than the rib height and smaller than eight times the rib height. Preferably, when there is an uneven number of ribs, the central rib has a greater height than the remaining ribs and, in the case of an even number of ribs, the pair of central ribs can be of greater height than the remaining ribs. The rib height can diminish toward the edge of the tooth cap.

The longitudinal ribs can merge with rounded transitions into the flank surface and the crests of the ribs likewise can be rounded.

When the tooth cap is used for a tooth of a loader bucket or the like, it may be advantageous to form one of the working flanks with the longitudinal and/or transverse ribs of the invention while the other working flank is substantially planar and may be formed with longitudinal grooves. In this case, the planar or grooved surface may be the surface which is pressed against the ground while the surface formed with the longitudinal and/or transverse ribs is the tearing surface which lifts the ground structure. This has been found to maximize the direction-reducing effect and minimize the force required for penetration of the teeth. The longitudinal grooves in the working surface which is pressed against the ground has been found to be effective in reducing the force for displacement of the teeth by reducing the friction effect even when no loosening of the ground is effected.

When such longitudinal grooves are provided, they can be spaced apart across the width of the tooth cap and preferably these grooves can in cross section have a wavy pattern. The grooves can be provided in a number and in spacing to correspond to those of the longitudinal ribs and can have the same orientations as the ribs.

According to another feature of the invention, the edges of the tooth cap are outwardly bulged. The bulging appears to provide a form of undercut behind the advancing surfaces of the wedge-shaped portions that contributes to a reduction of friction during the penetration. The bulge can run from the tip of the wedge-shaped portion substantially the full length of the ribs and to the socket.

Especially for tooth caps which are used for excavators or where chisel-shaped teeth are required, it has been found to be advantageous to provide centrally of one or both of the working blanks a wedge-shaped longitudinal rib which can be defined by a pair of converging longitudinal ribs which meed substantially at the leading edge or tip of the tooth cap. Between these converging ribs, a flat or shallow valley may be formed and flanking these longitudinal ribs, there may be a pair of deeper valleys. The wedge-shaped longitudinal rib structure provides additional stiffening of the tooth cap and has also been found to be highly effective in a ripping and slight loosening action. The converging longitudinal ribs, moreover, have the effect of a fork in their loosening action.

It has been found to be advantageous, moreover, to provide the surfaces alongside the ribs with indentations or outwardly convex curved contours. Especially advantageous is an embodiment in which a central rib structure is provided, according to the invention, and transverse ribs are formed in the working flanks outwardly thereof. These transverse ribs can have a sawtooth configuration and can be provided with flanks turned toward the cutting edge or tip of the cap which are shallower or less steeply inclined than the flanks turned toward the socket portion.

The chisel action of the resulting cap has shown that it is effective in all kinds of excavators, grabs, back-hoes, front-loaders and the like. The transverse ribs also form undercuts or spaces behind the rib crests which reduce friction and hence the force required for operating with the respective teeth. The transverse ribs can be uniformly spaced from one another and as has been noted, one or both of the working flanks may be provided with the longitudinal and/or transverse ribs.

The tip of the tooth cap can be linear or arcuate transverse to the longitudinal dimension and centrally of the tip, a linear chisel edge can be formed which can be connected to arcuate or stepped edge regions connected to the lateral flanks of the tooth cap. The transverse ribs can be somewhat arcuate and can have centers of curvature located toward the end of the tooth cap which is remote from the tip and close to the axis of the pin holding the tooth cap onto the frustopyrimidal stump.

The transverse ribs also may be inclined outwardly away from the central rib. These configurations of the transverse ribs help the tooth cap in shedding loosened material and thereby contribute to a reduction in the compaction.

The spaces between the transverse ribs may also be grooved to form a channel structure which assists in the passage of the crushed or ground center and loosened soil away from the tooth cap when the latter is utilized in a chisel action.

BRIEF DESCRIPTION OF THE DRAWING

The above and other objects, features, and advantages will become more readily apparent from the following description, reference being made to the accompanying drawing in which.

SPECIFIC DESCRIPTION

FIGS. 1–4 show a tooth cap for a loader which has a cutting edge 1 at one end and a socket 2 at the opposite end, the latter being configured to receive a frustopyrimidal stub to which the tooth cap is attached by a tension pin passing through the holes 3 in the socket portion. The tip is formed on a wedge-shaped portion of the tooth cap body which is formed in one piece with the socket 1 and this body can be mounted on the stub of the bucket, grab or other excavating part of a construction machine, for example a grab, bucket, a loader bucket or the like. The tooth cap, when worn, can be removed by extracting the tension pin and can be replaced on the stub with reinsertion of the tension pin.

Figure 1:
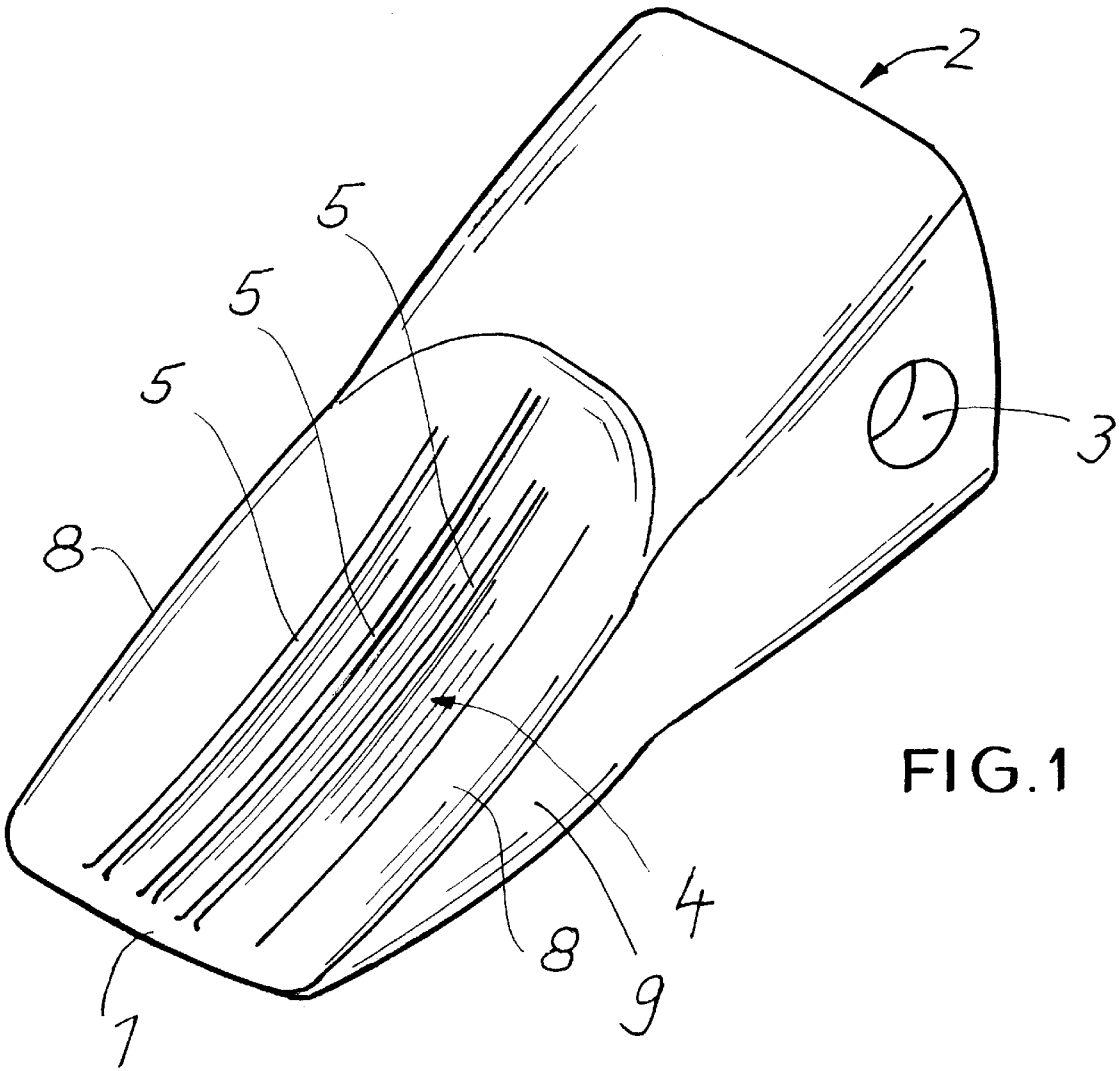
FIG. 1 is a perspective view of a tooth cap for a loader according to a first embodiment of the invention.
Figure 2:
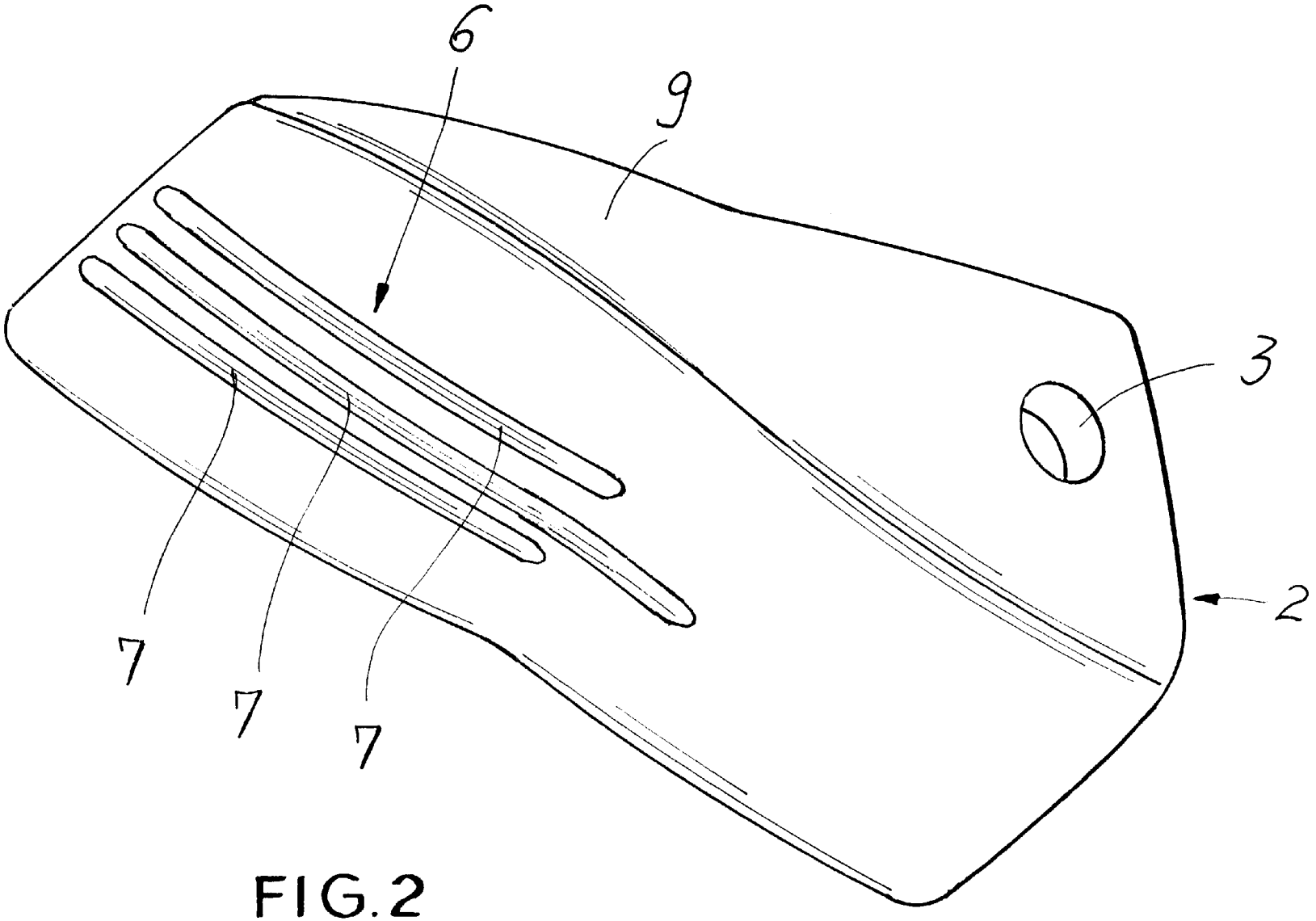
FIG. 2 is a bottom perspective view of the tooth cap of FIG. 1.
Figure 3:
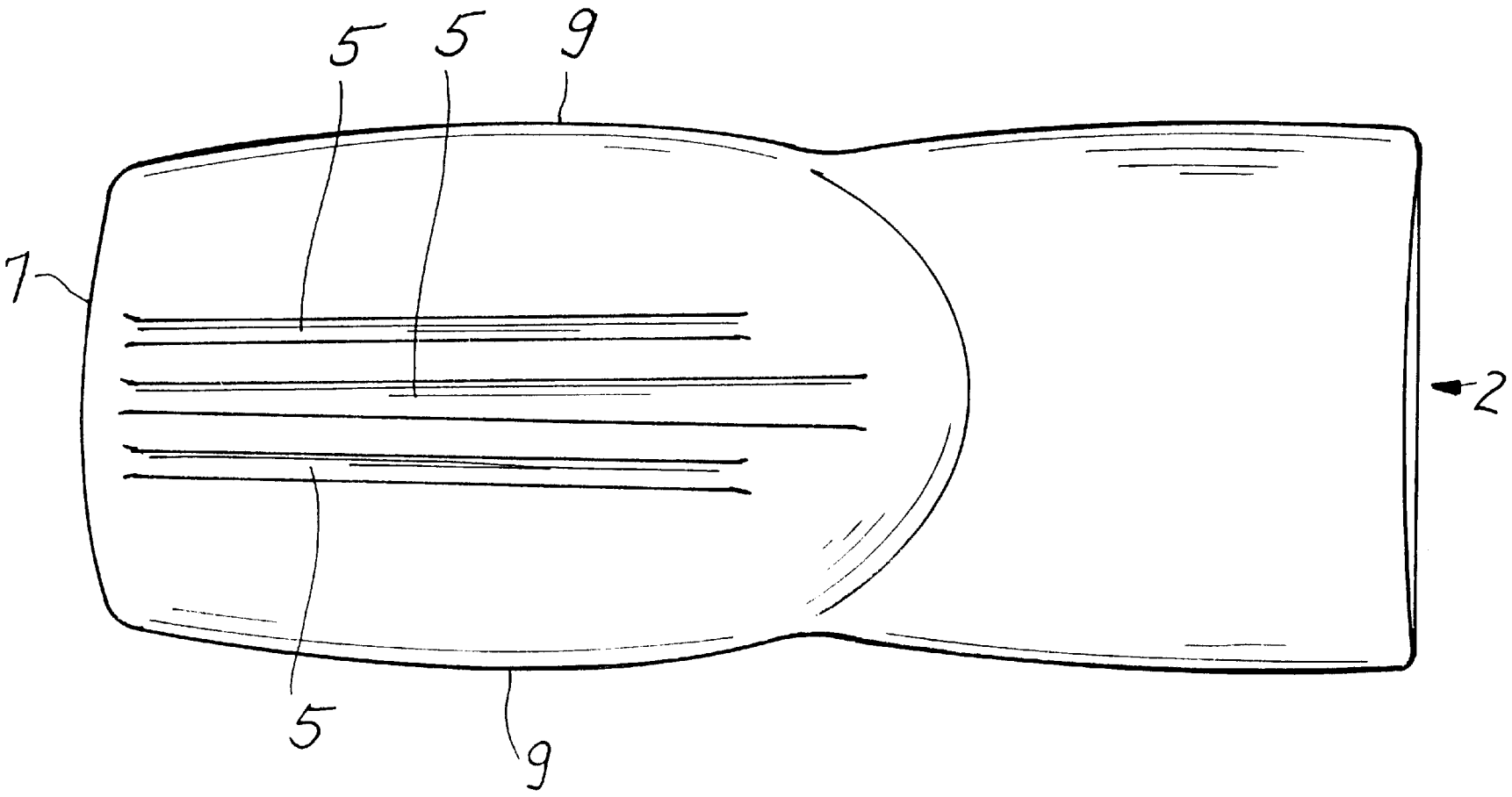
FIG. 3 is a top view of this tooth cap.

The socket 2 serves for mounting the tooth cap and is not a working part of the body. The working part of the body is wedge-shaped or chisel-shaped and is defined between two working flanks or surfaces 4. The surface on the upper side seen in FIG. 1 is formed with a plurality of longitudinal ribs 5 which begin at the cutting edge 1 and run substantially to the socket 2. On the underside, the working flank is formed with a corresponding number of longitudinal grooves 7 which run from the cutting edge 1 to the socket 2.

Figure 4:
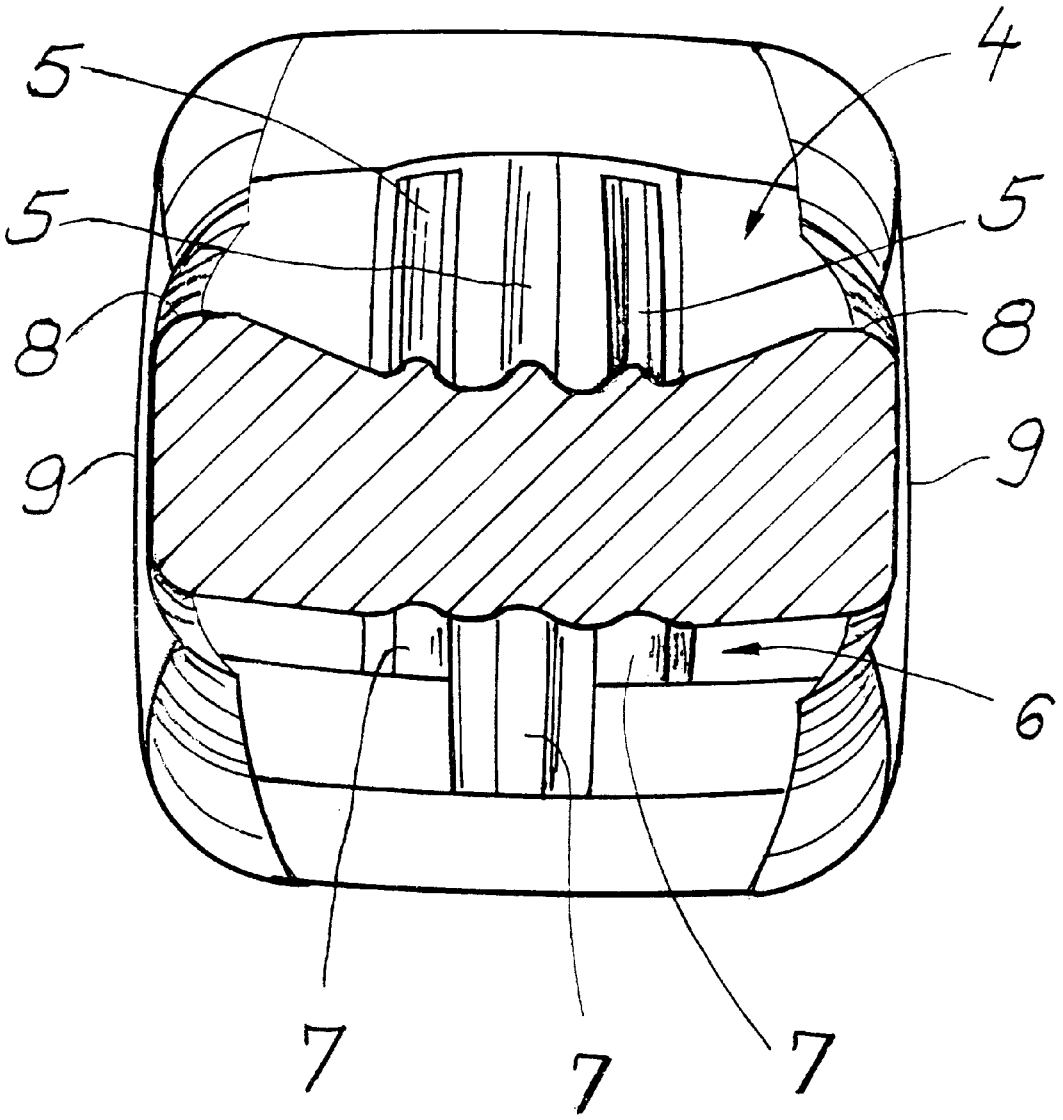
FIG. 4 is a cross sectional view through the tooth cap of FIGS. 1–3.
Figure 5:
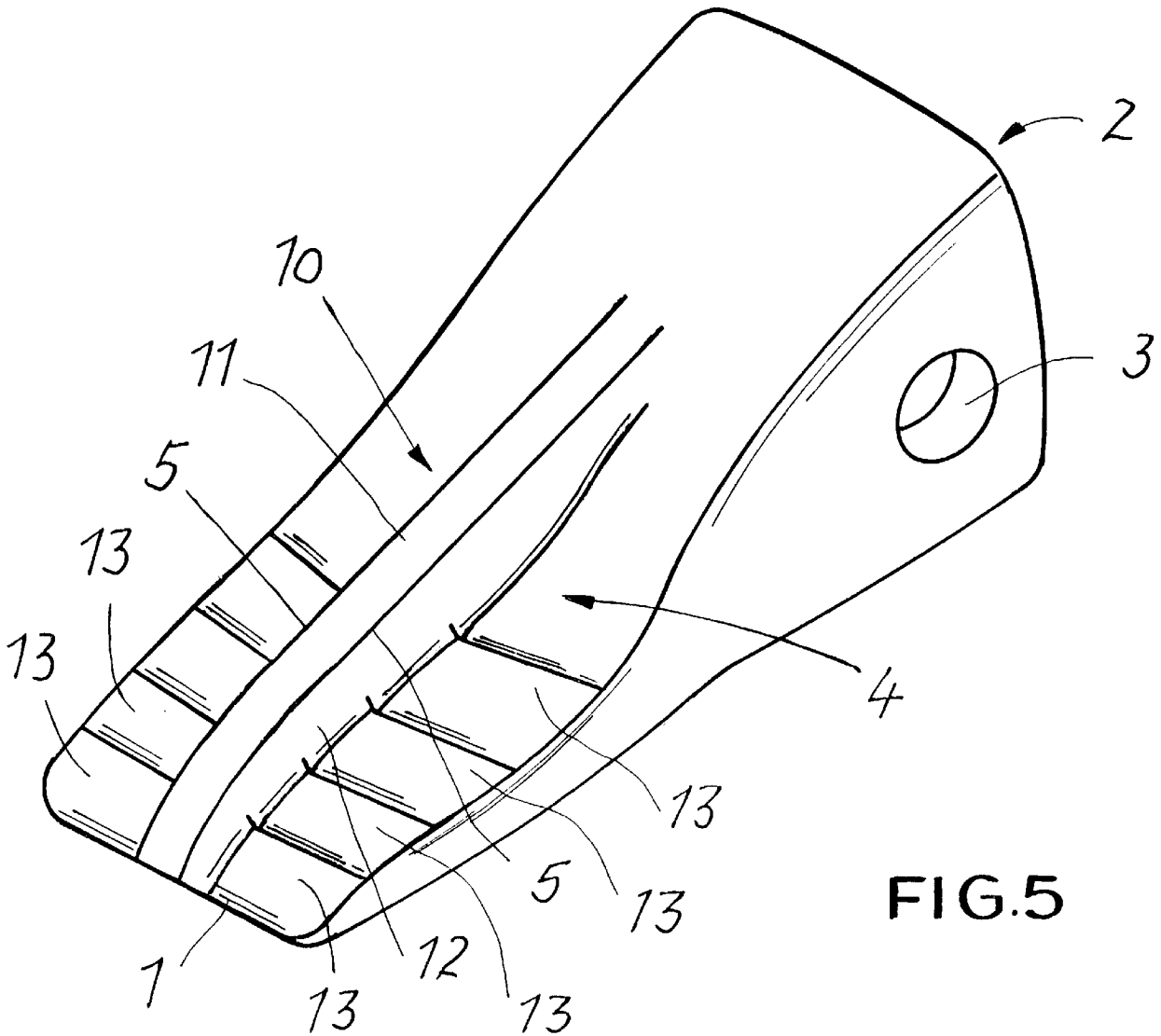
FIG. 5 is a view similar to FIG. 1 of another tooth cap according to the invention.

As can be seen from FIGS. 1 and 4, the upper working flank 4 is indented or recessed transversely to the longitudinal dimension of the tooth cap and can be seen to have a curved concave cross section in FIG. 4. The three longitudinal ribs run generally parallel to the longitudinal edges 8 or sides 9 of the wedge-shaped portion and are of such height that they are set back below the edges 8. The longitudinal ribs 5 also have a spacing from one another which is greater than the height of the ribs but smaller than eight times the rib height. The central rib 5 has a greater height than the ribs outwardly therefrom and the height of the ribs decreases outwardly from the central rib. The ribs 5 have rounded transitions with the surface of the flank 4 and with the tip 1 and the socket 2 and the crests of the ribs are likewise rounded. The overall appearance in cross section, therefore, is a wavy one (see FIG. 4).

The longitudinal grooves 7 on the underside also impart to the wedge-shaped portion a wavy profile as is also visible in FIG. 4 and the grooves 7 are equal in number to the ribs 5 and have the same orientations as the ribs 5. The working flank 6 in which the grooves 7 are provided is otherwise generally flat.

The sides 9 bulge outwardly (see especially FIGS. 1 and 3), these sides connecting the working flanks 4 and 6. The bulge runs the length of the ribs 5 for the groove 7.

Figure 6:
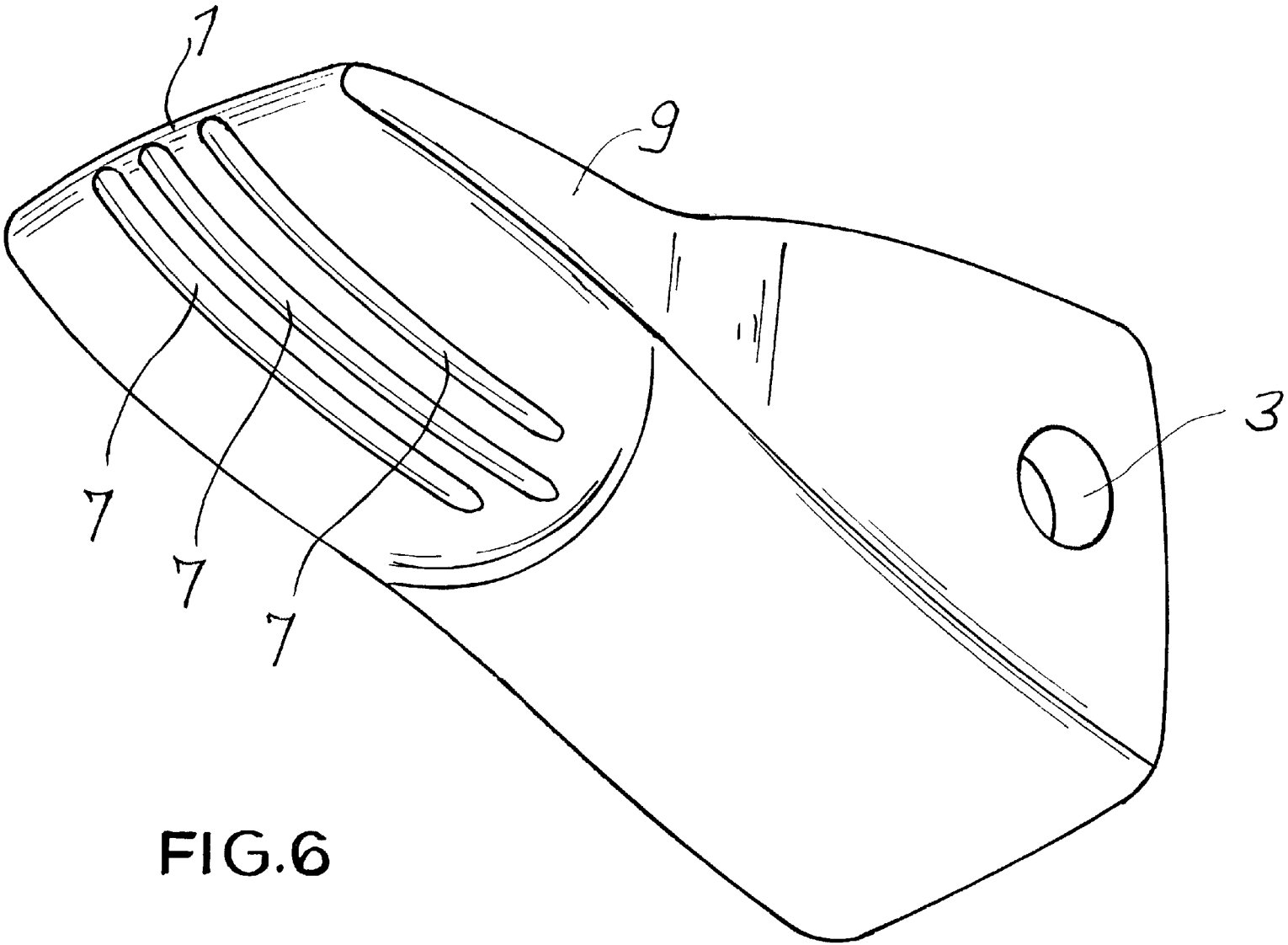
FIG. 6 is a bottom perspective view of the second embodiment of the tooth cap.
Figure 7:
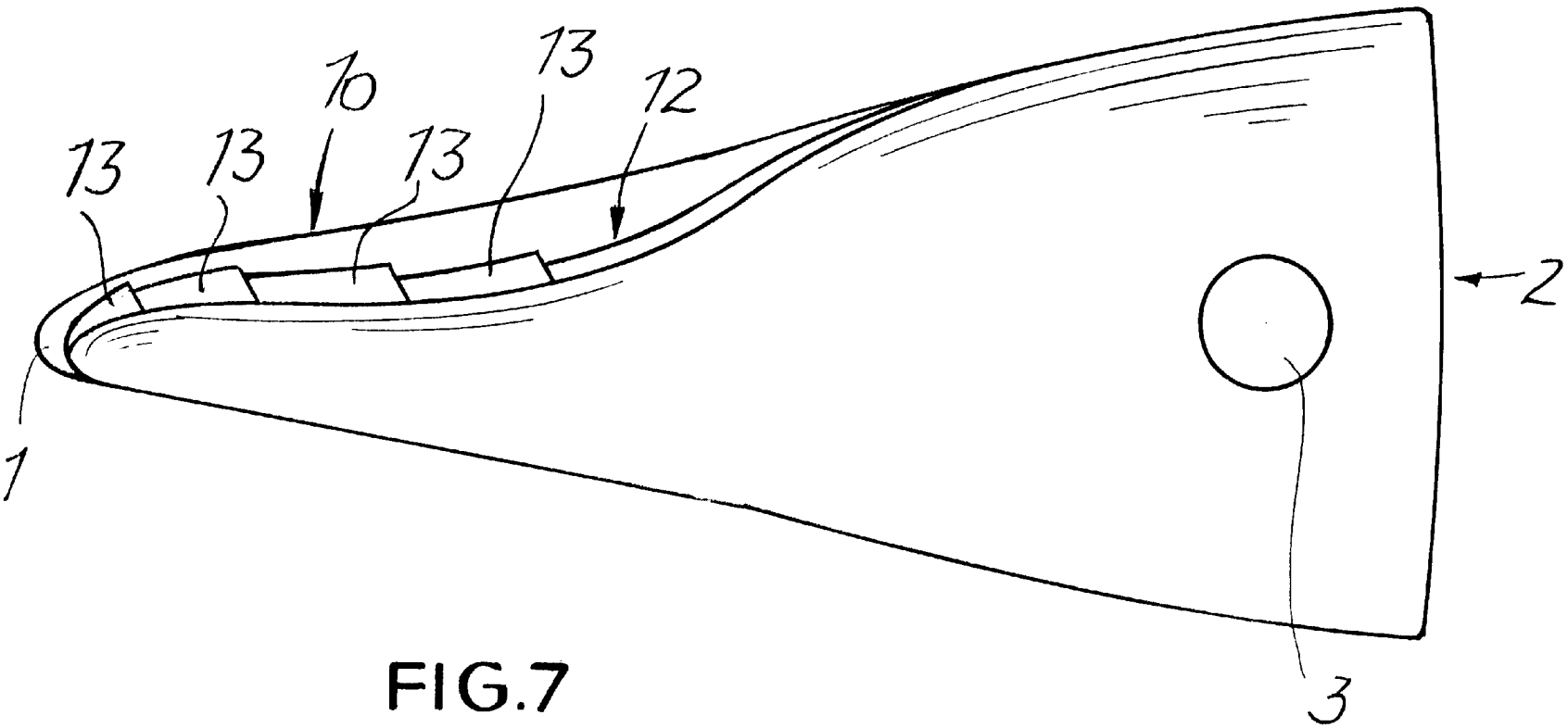
FIG. 7 is a side elevational view of the second embodiment.
Figure 8:
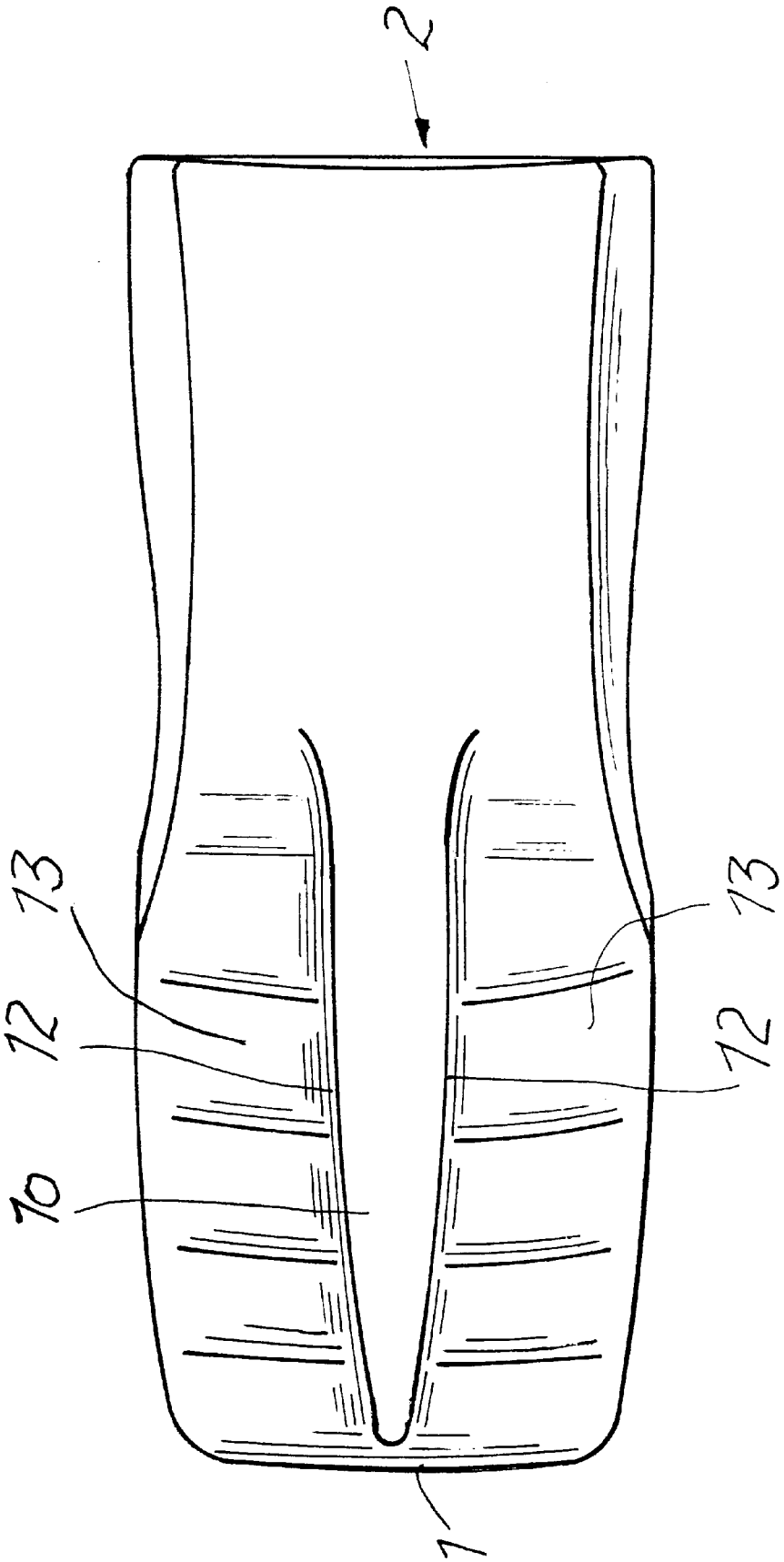
FIG. 8 is a top view of the second embodiment.
Figure 9:
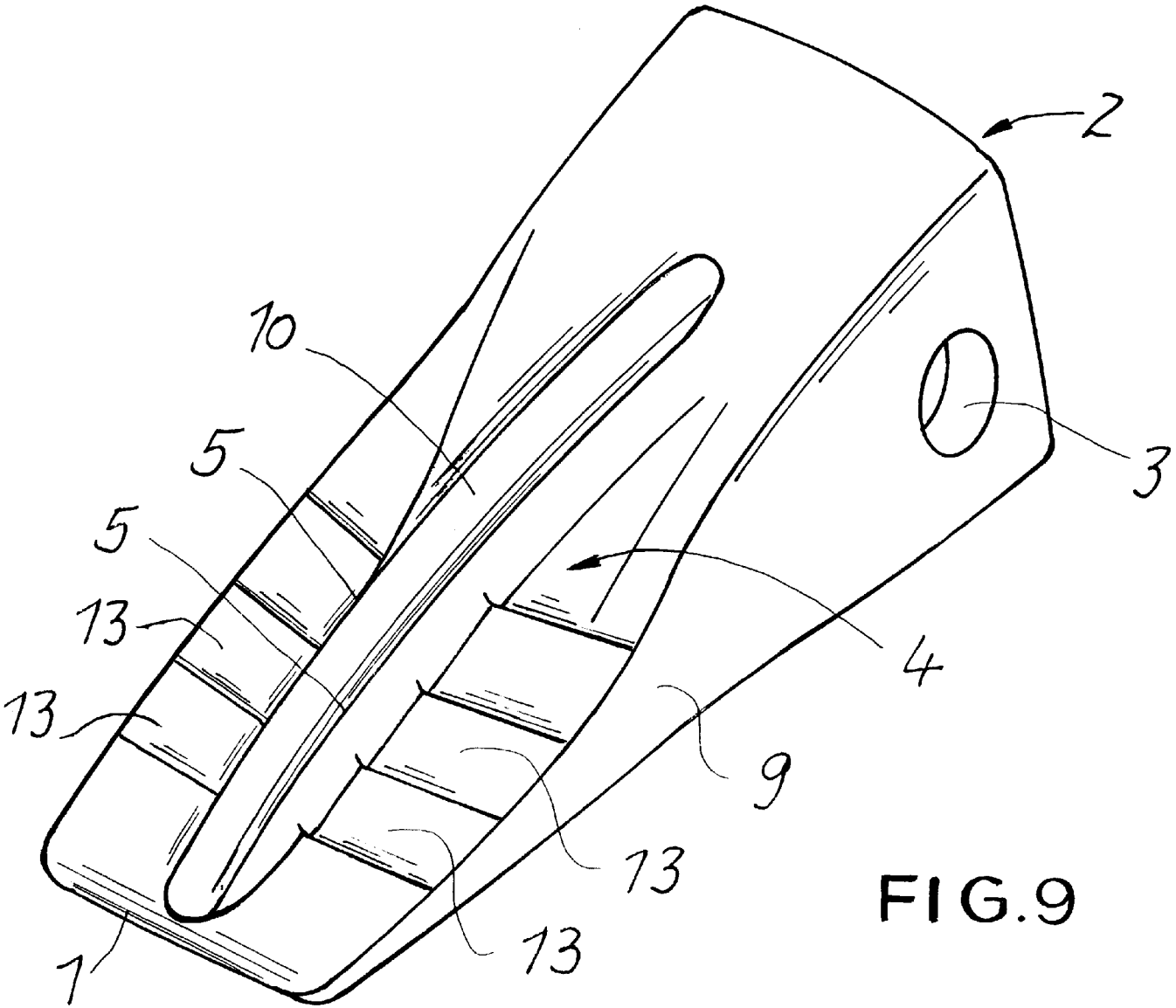
FIG. 9 is a top perspective view of a third embodiment of a tooth cap for a dredge, grab or like excavator according to the invention.
Figure 10:
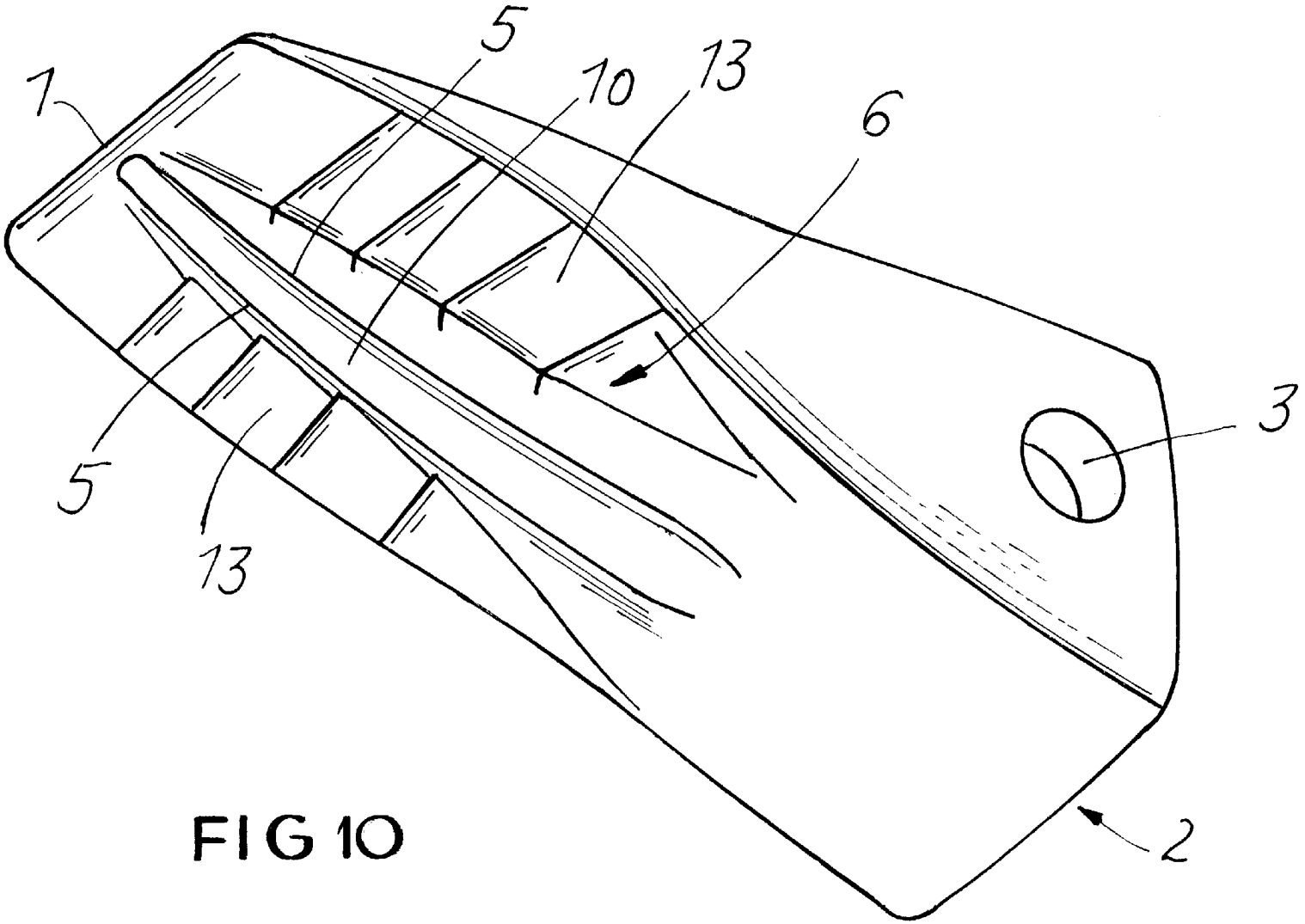
FIG. 10 is a bottom perspective view of the third embodiment.
Figure 11:
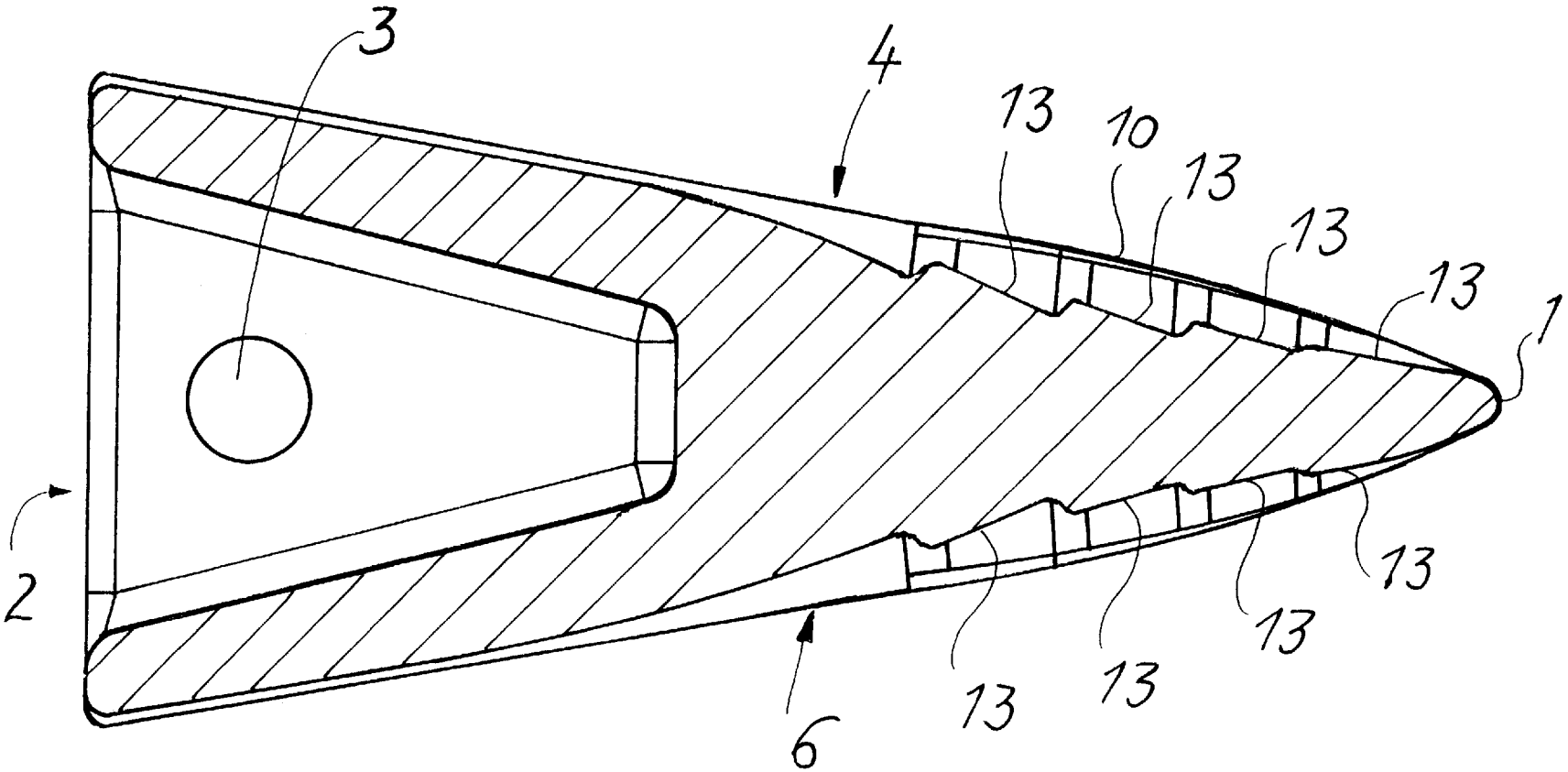
FIG. 11 is a longitudinal section through the third embodiment.
Figure 12:
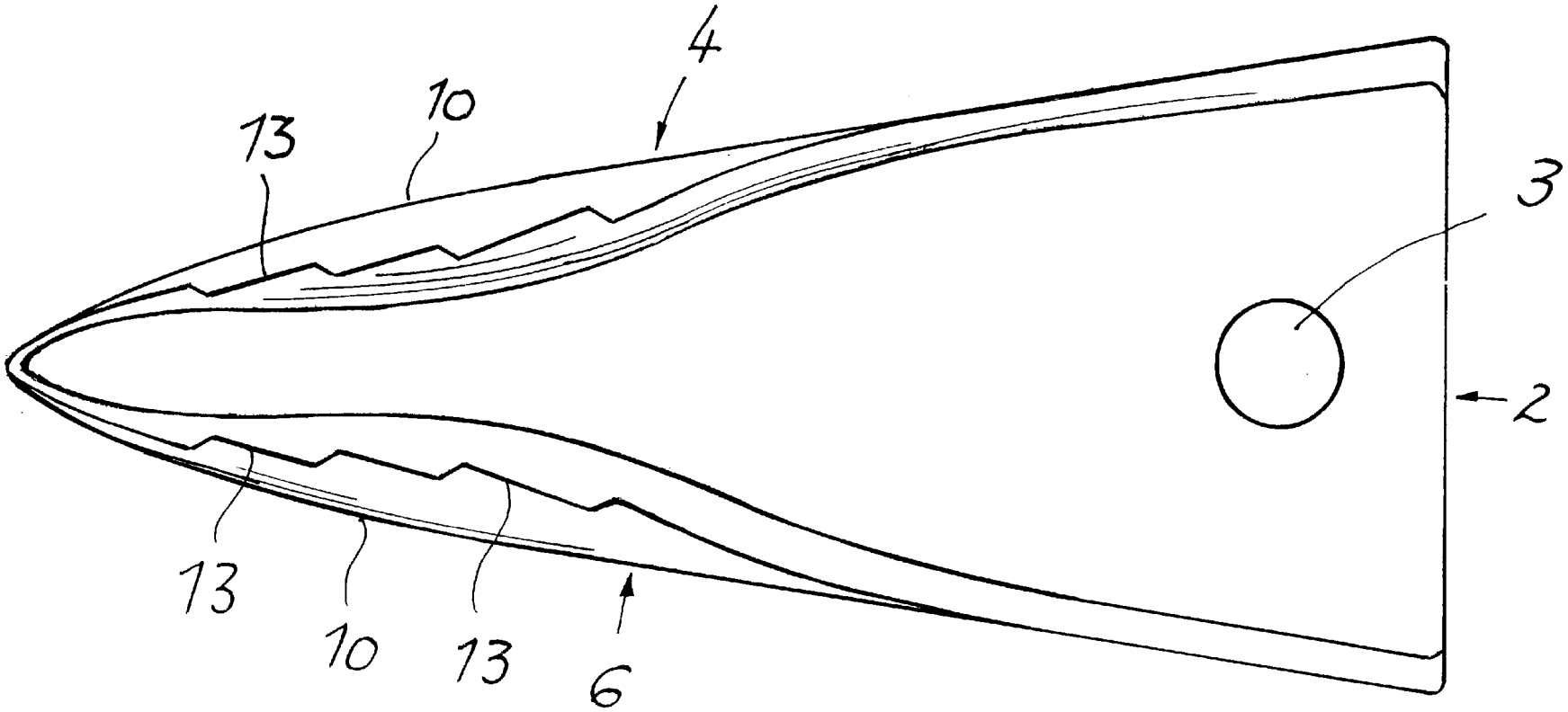
FIG. 12 is a side elevational view of the third embodiment.
Figure 13:
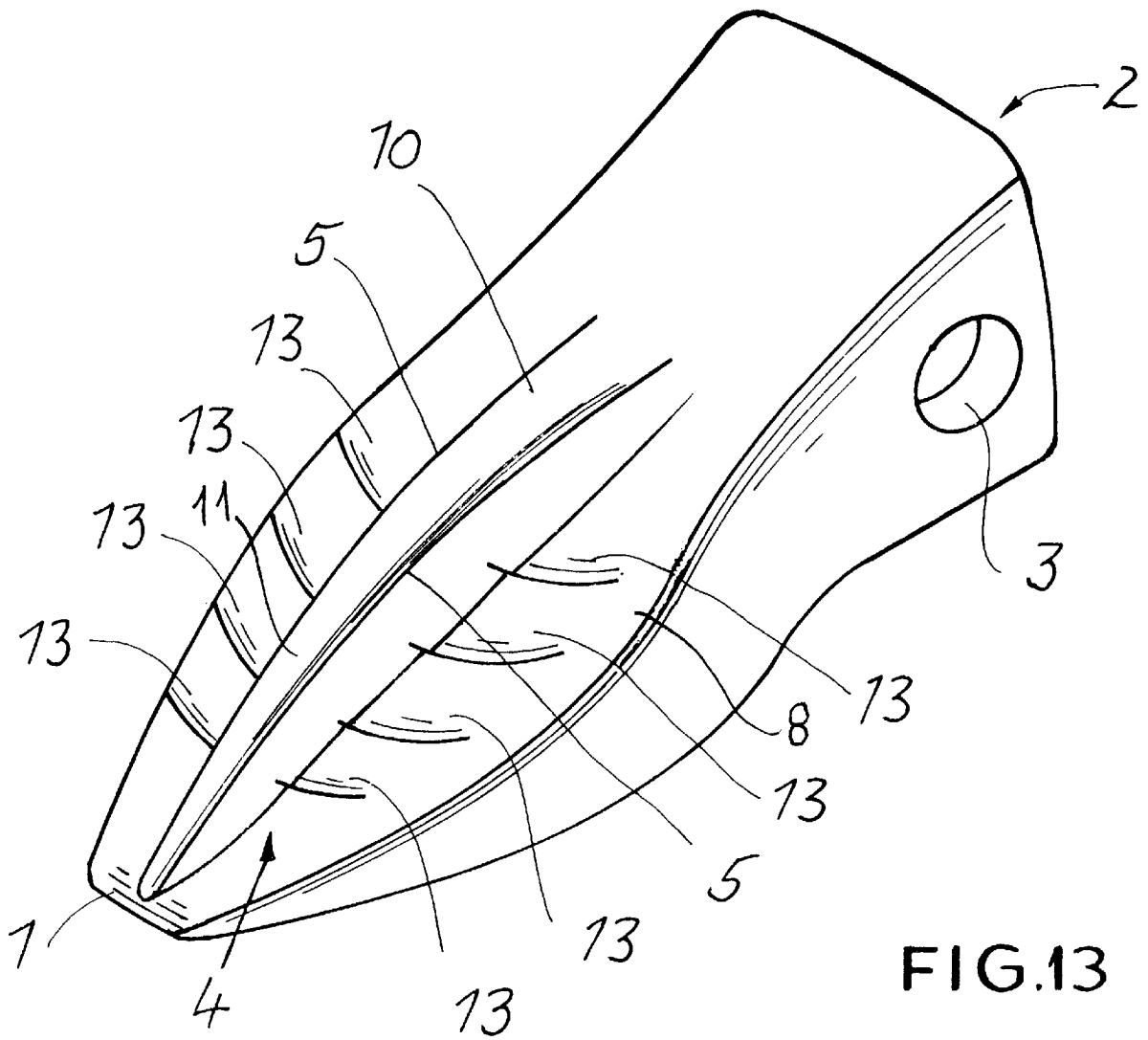
FIG. 13 is a top perspective view of a fourth embodiment.

In the embodiment of FIGS. 5–8, the longitudinal rib 10 on the upper working flank 4 is formed from a pair of converging ribs 5 which define a shallow valley 11 between them and have steep valleys 12 which are deeper between these ribs 5 and the outer edges of the wedge-shaped portion. The surface between the ribs 5 and the outer edges is also indented or concave as has been described with respect to the previous embodiment and is formed with a plurality of substantially uniformly-spaced transverse ribs 13. These ribs 13 are of a sawtooth shape (FIG.7) and have surfaces which extend toward the cutting edge 1 which are shallower than the surfaces turned toward the socket 2. The underside of the tooth cap as can be seen from FIG. 6 is generally flat and provided with grooves 7 as has been described in connection with the embodiment of FIGS. 1–4.

In the embodiment of FIGS. 9–12, the two working surfaces or flanks 4, 6 of the tooth cap are shaped similarly and approximately like the embodiment previously described at the upper side. While the tooth caps thus far described have been used primarily as loader teeth for bucket loaders, front-end loaders and like equipment, the tooth cap of FIGS. 9–12 are used as excavator, dredge or grab teeth. In the previous embodiments the tip or cutting edge of the tooth tended to be linear or slightly rounded whereas in the case of grabs or dredges, it is advantageous to use a more rounded form of the tip and to provide a center of curvature for the cutting edge which is located close to or in the socket portion 2 thereof. In the embodiment of FIGS. 13–16 for example, the central portion of the cutting edge is linear and chisel-shaped and adjoins the sides which can be rounded at a step or arc. The sides can be more rounded to a greater extent (see FIGS. 13–16 in that regard).

In the embodiment of FIGS. 17–20, however, the central portion of the cutting edge is linear and chisel-shaped and that portion merges into arcs forming the remainder of the tip or cutting edge.

Figure 14:
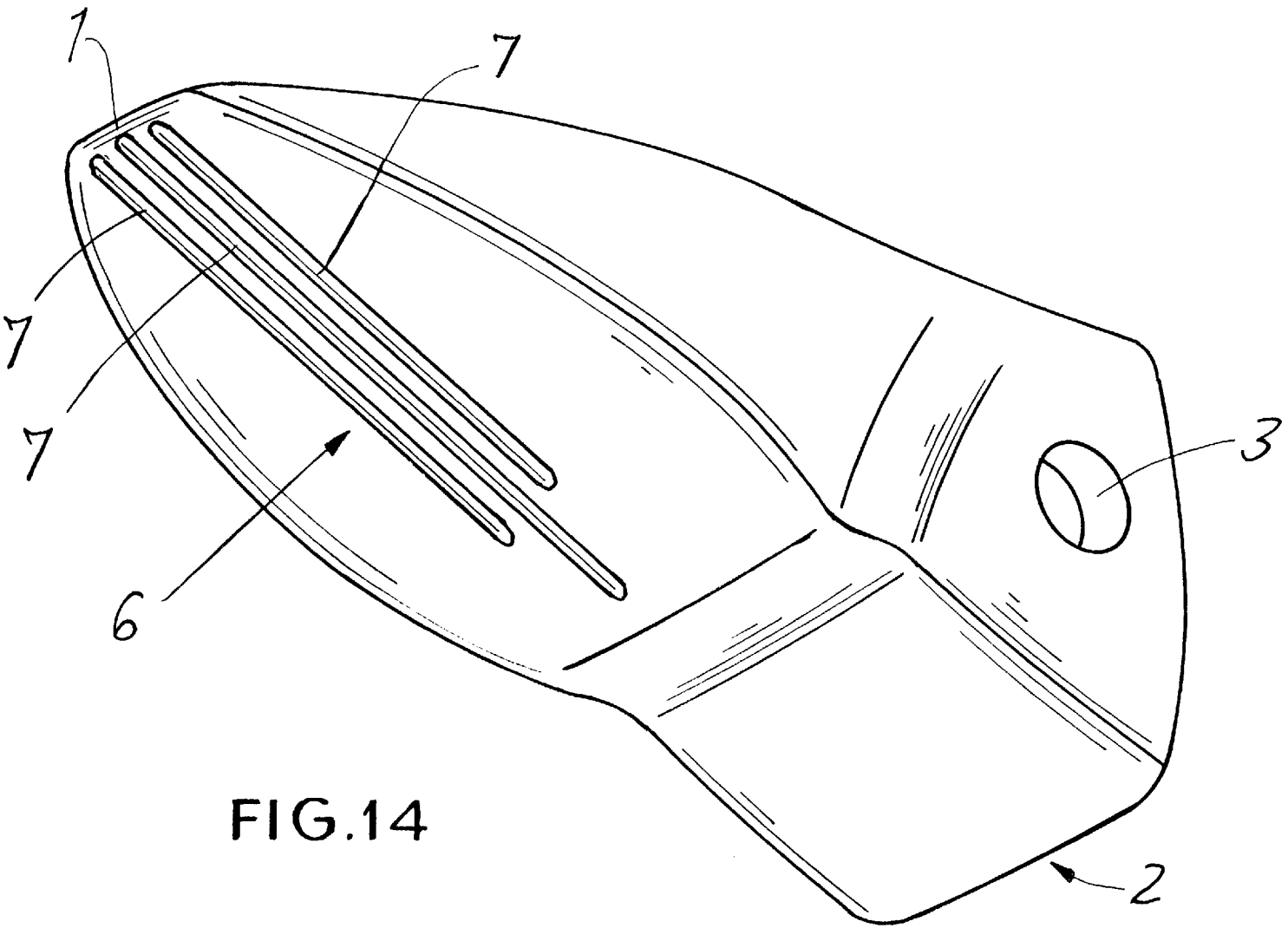
FIG. 14 is a bottom perspective view of the fourth embodiment.
Figure 15:
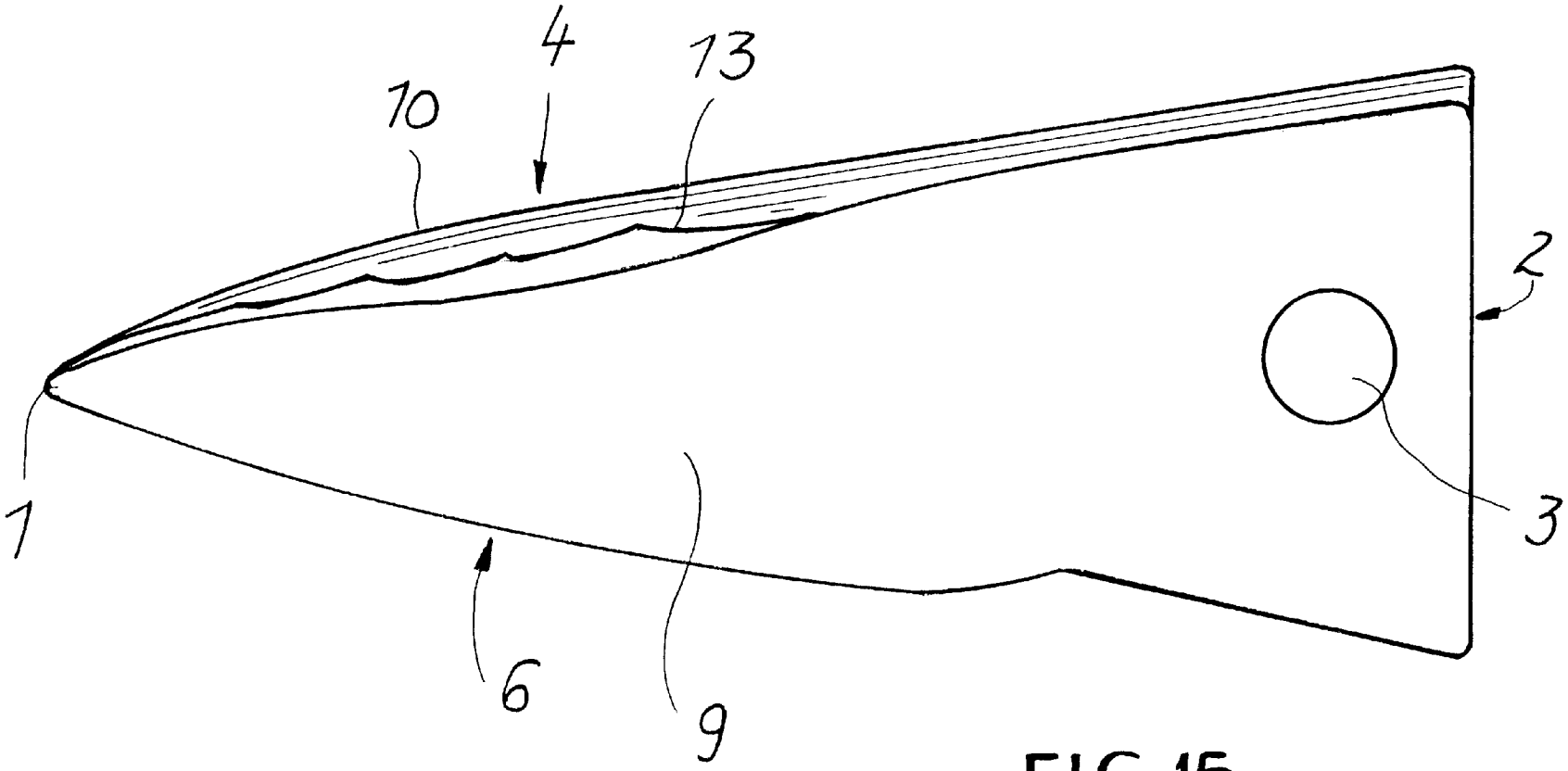
FIG. 15 is a side elevational view of the fourth embodiment.
Figure 16:
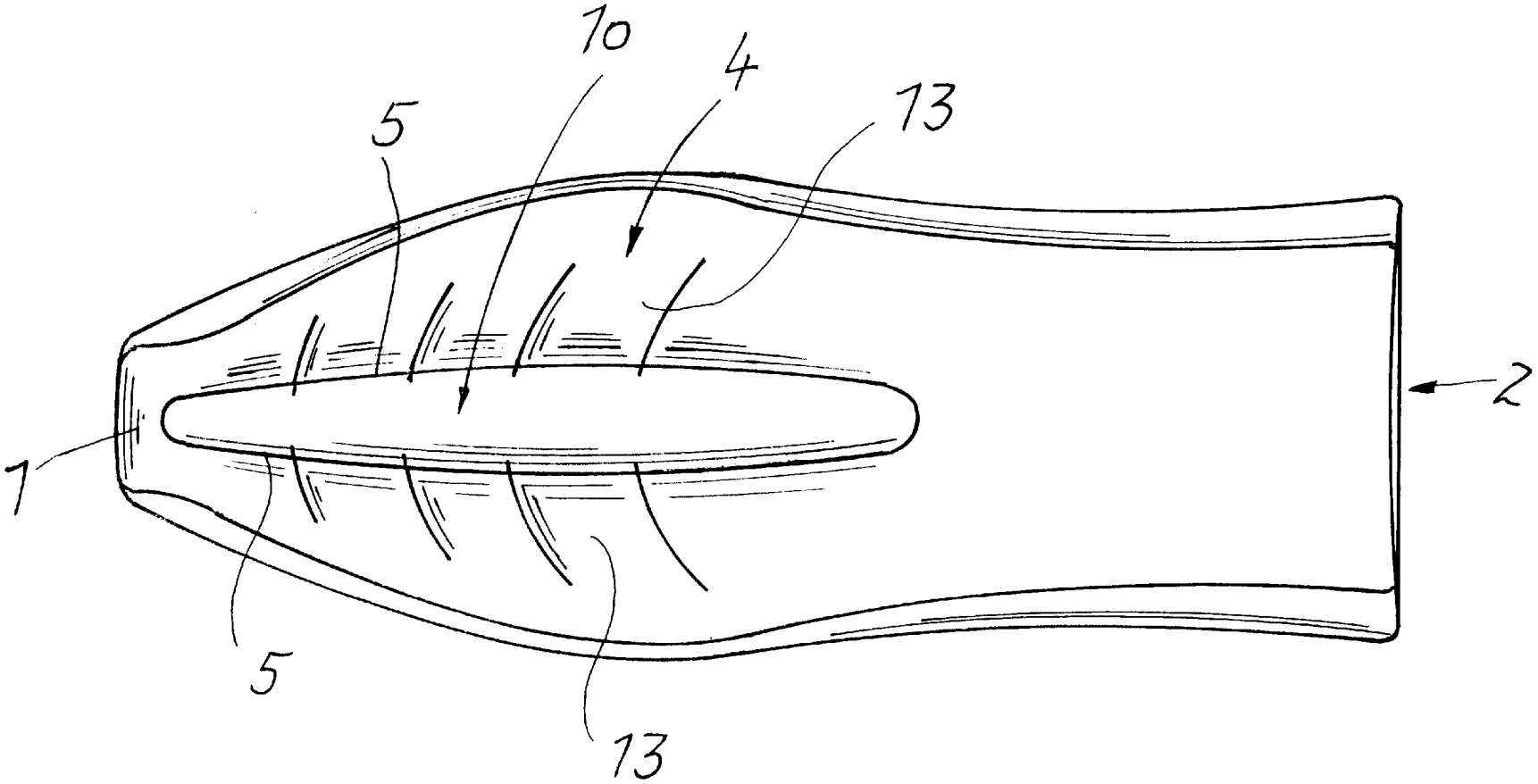
FIG. 16 is a top view of the fourth embodiment.
Figure 17:
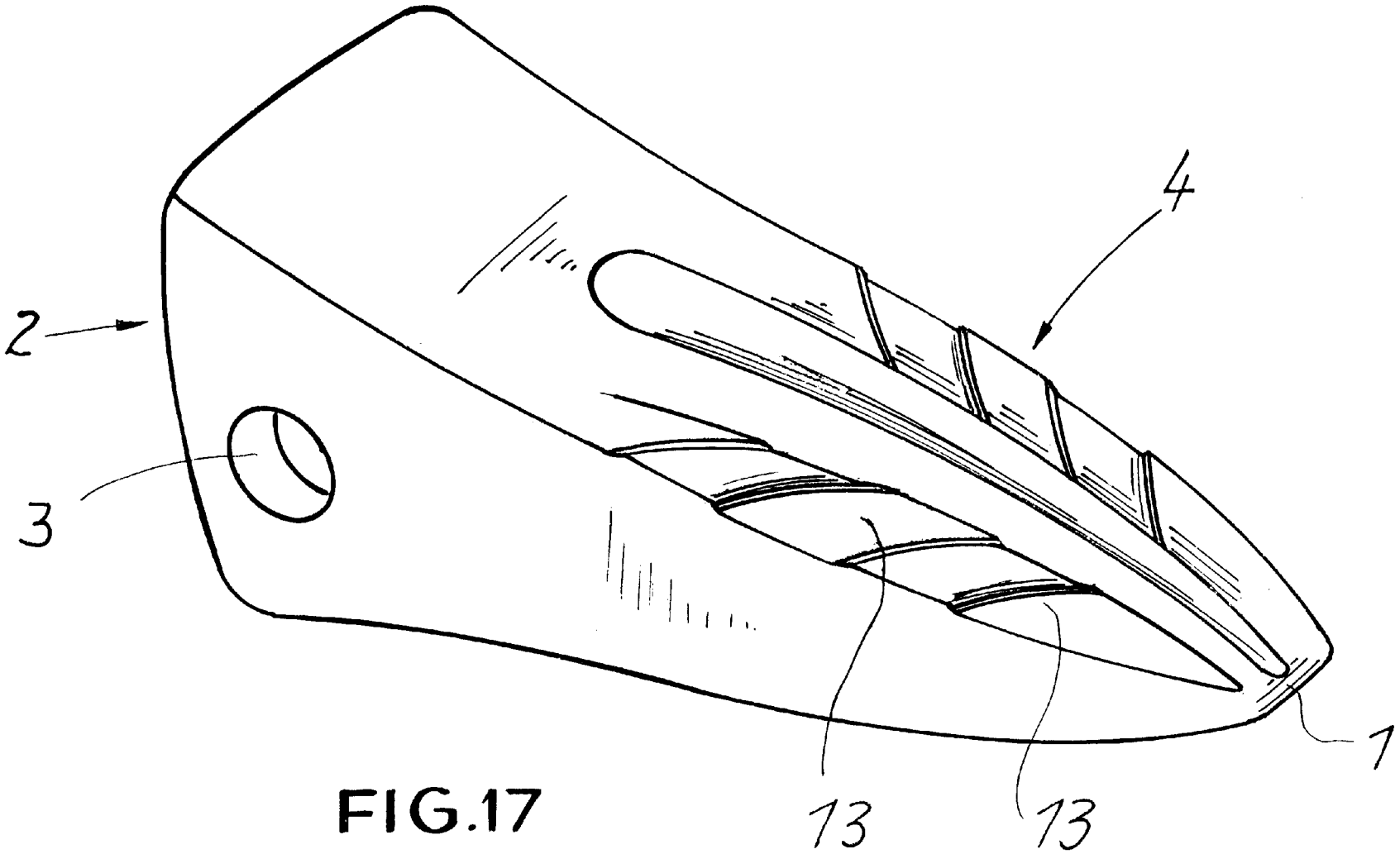
FIG. 17 is a top perspective view of a fifth embodiment of the invention.
Figure 18:
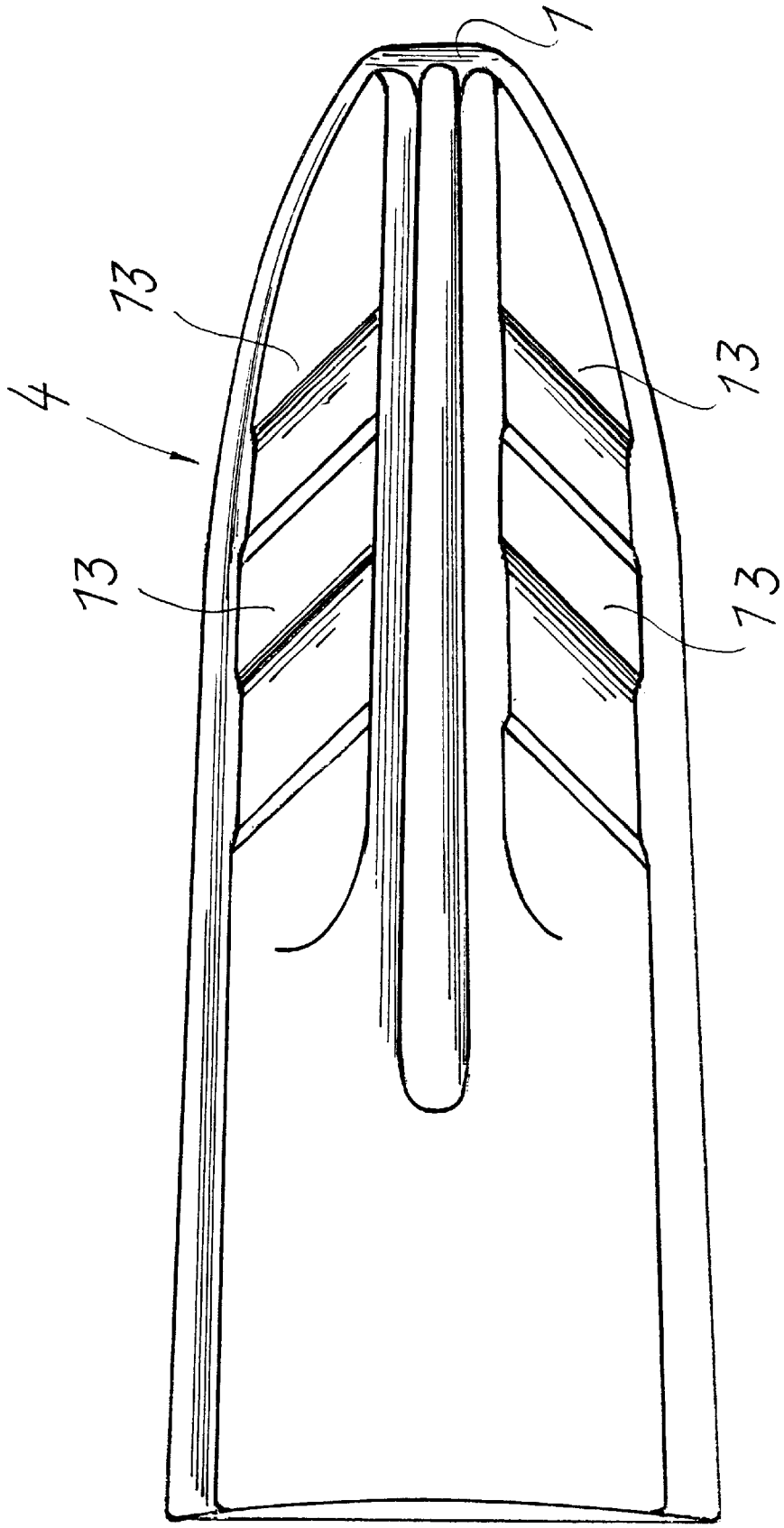
FIG. 18 is a top view of the fifth embodiment.
Figure 19:
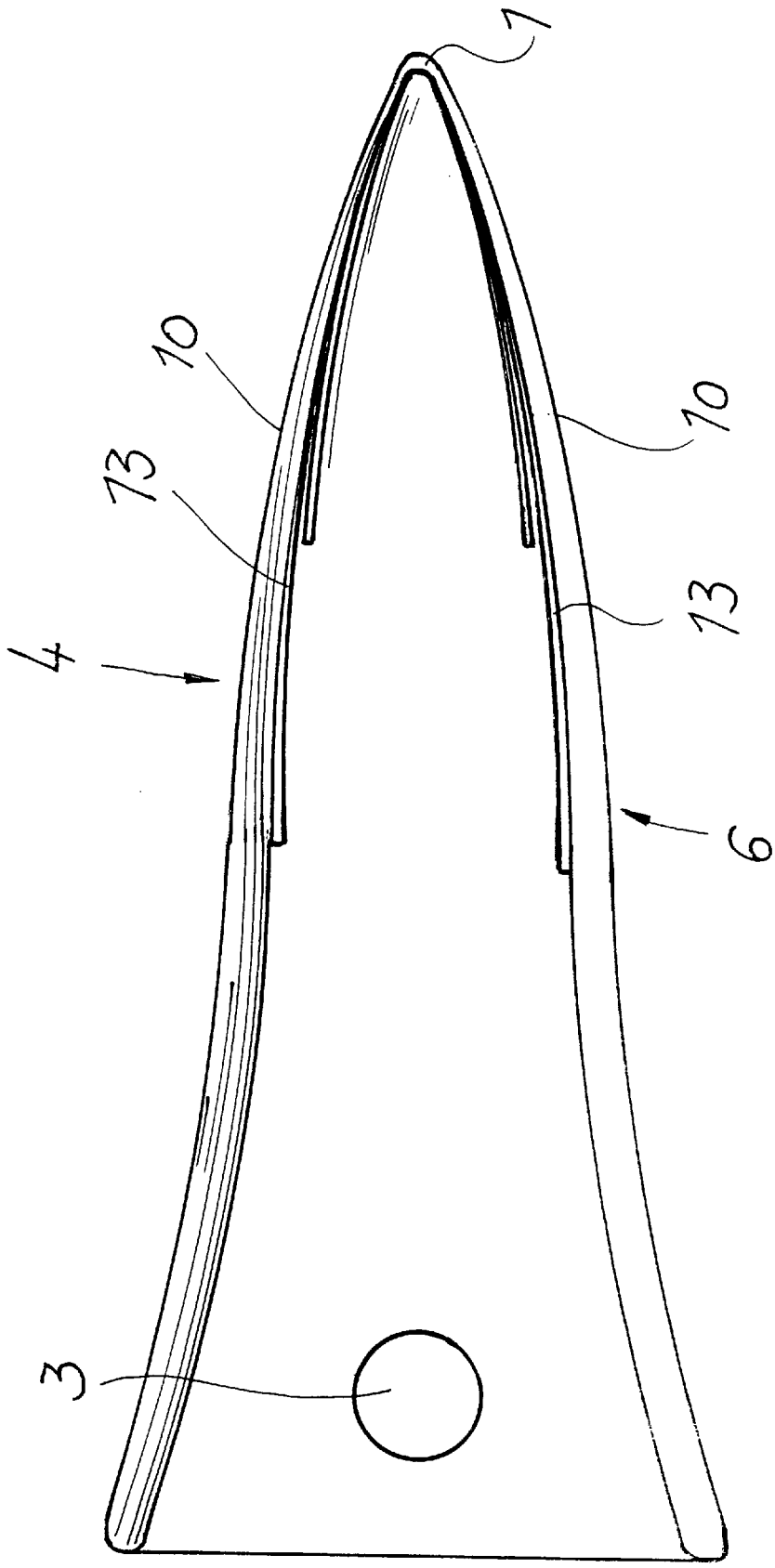
FIG. 19 is a side elevational view of the fifth embodiment.
Figure 20:
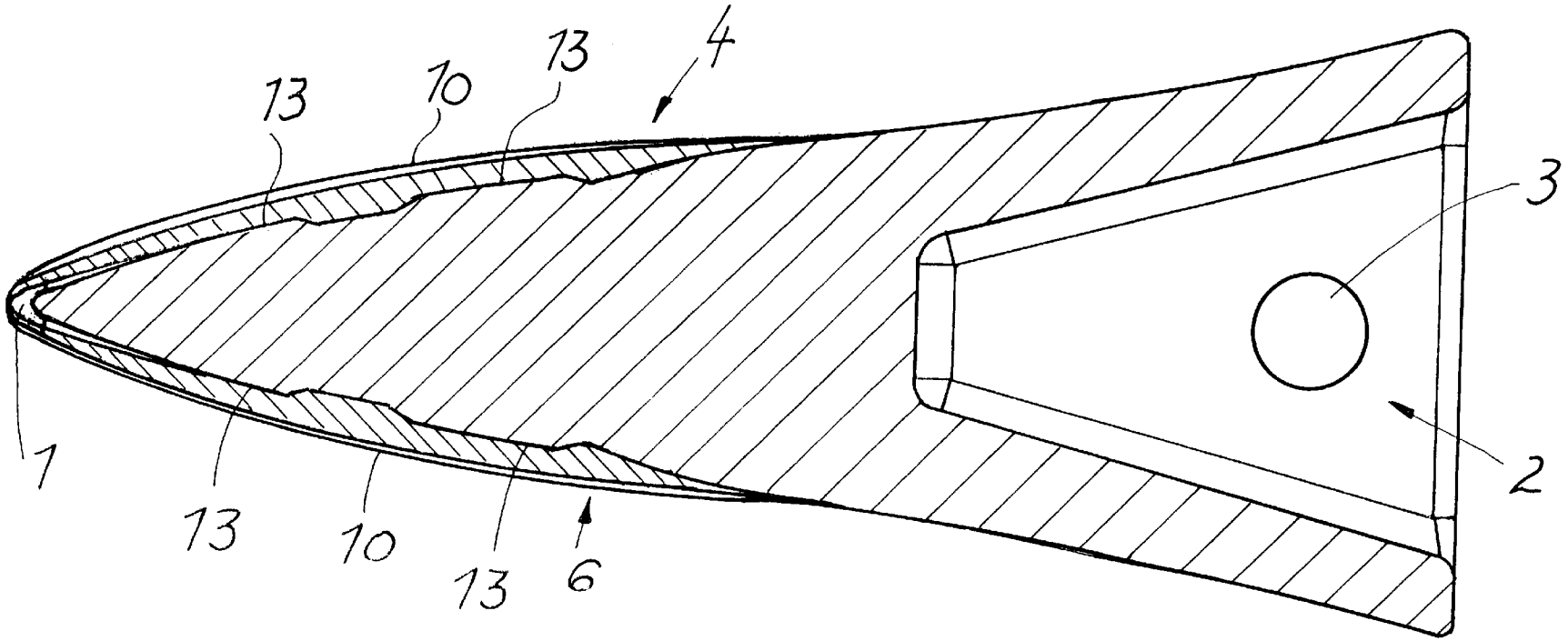
FIG. 20 is a longitudinal cross section through the fifth embodiment.

In the embodiment of FIGS. 13–16, the transverse ribs 13 are somewhat arcuate and have their centers of curvature located toward the socket end 2 of the tooth cap. The transverse ribs 13 meet the central longitudinal rib 11 at approximately a right angle and closer to the tip 1 than these transverse ribs meet the edges 8. With this configuration, the detritus removed by excavation can be deflected aside. In the embodiment of FIGS. 13–16, moreover, the lower surface can be similarly configured or can be provided with grooves 7 as shown in FIG. 14 and in a manner corresponding to that of the embodiment of FIGS. 1–4. By contrast, in the embodiment of FIGS. 17–20, the transverse ribs 13 are arrow-shaped with respect to the central rib and converge from opposite sides toward the central rib. Between the transverse ribs 13, a groove-like channel construction is provided to facilitate deflecting material outwardly.

The invention is, of course, not limited to the embodiments described by way of example and includes all structures described individually and in combination within the scope of the accompanying claims.

I claim:

1. A tooth cap for construction machinery comprising a chisel-shaped body formed with a socket and a wedge-shaped portion extending from said socket and having a pair of mutually converging working flanks, at least one of said working flanks being formed with a plurality of ribs, said ribs including longitudinal ribs, and wherein for an odd number of said ribs, a central one of said ribs and for an even number of ribs a central pair of said ribs have heights greater than the other ribs and the rib height decreases toward edges of said wedge-shaped portion of said body.

2. The tooth cap defined in claim 1 wherein the other of said flanks is substantially flat and is formed with a longitudinal groove.

3. The tooth cap defined in claim 2 wherein a plurality of grooves are provided in said other of said flanks.

4. The tooth cap defined in claim 3 wherein said grooves are spaced apart substantially by a width of said grooves.

5. The tooth cap defined in claim 4 wherein said grooves form a wavy line in cross section.

6. The tooth cap defined in claim 5 wherein said grooves are provided in the same number and same orientation as said ribs.

7. The tooth cap defined in claim 1 wherein said wedge-shaped portion has a pair of outwardly bulging edges interconnecting said flanks.

8. The tooth cap defined in claim 7 wherein the outward bulges of said edges run from a tip of said wedge-shaped portion to a region at which said longitudinal ribs terminate proximal to said socket.

9. The tooth cap defined in claim 1 wherein said ribs merge into said at least one of said flanks at rounded transition zones and said ribs have rounded crests.

10. A tooth cap for construction machinery comprising a chisel-shaped body formed with a socket and a wedge-shaped portion extending from said socket and having a pair of mutually converging working flanks, at least one of said working flanks being formed with a plurality of ribs, said at least one of said flanks being formed with a wedge-shaped longitudinal rib defined by a pair of converging longitudinal ridges having a shallow valley between them and merging into said one of said flanks at respective deeper valleys.

11. The tooth cap defined in claim 10 wherein said surface is formed between said ridges and edges of said wedge-shaped portion with outwardly concave curved recessed surfaces.

12. The tooth cap defined in claim 10 wherein transverse ribs are provided between said ridges and said edges of the wedge-shaped portion, said transverse ribs having a sawtooth cross section with flanks turned toward a tip of the wedge-shaped portion which are less steep than flanks of the sawtooth cross section facing away from said tip.

13. The tooth cap defined in claim 10 wherein said transverse ribs are uniformly spaced apart.

14. The tooth cap defined in claim 10 wherein both of said flanks are provided with a respective said wedge-shaped longitudinal rib defined by a respective pair of converging longitudinal ridges having a shallow valley between them and merging into the respective flank at respective deeper valleys.

15. A tooth cap for construction machinery comprising a chisel-shaped body formed with a socket and a wedge-shaped portion extending from said socket and having a pair of mutually converging working flanks, at least one of said working flanks being formed with a plurality of ribs, said ribs including longitudinal ribs, said at least one of said working flanks being formed with an outwardly concave curved recessed surface between edges of said wedge-shaped portion and said surface is formed with a plurality of longitudinal ribs on a central portion of said surface generally parallel to said edges, said ribs having heights such that said ribs are set back below said edges.

* * * * *